United States Patent [19]

Münzebrock et al.

[11] Patent Number: 5,064,972

[45] Date of Patent: Nov. 12, 1991

[54] CURRENT CONTACT LINE ARRANGEMENT

[75] Inventors: Anton Münzebrock, Dortmund; Heinz Pfannkuche, Bochum, both of Fed. Rep. of Germany

[73] Assignee: Mannesmann Aktiengesellschaft, Düsseldorf, Fed. Rep. of Germany

[21] Appl. No.: 547,498

[22] Filed: Jul. 2, 1990

[30] Foreign Application Priority Data

Jun. 30, 1989 [DE] Fed. Rep. of Germany ..... 3922007

[51] Int. Cl.[5] ..... B60M 1/02

[52] U.S. Cl. ..... 191/30; 191/39

[58] Field of Search ..... 191/1 R, 25, 28, 30, 191/31, 39; 238/152, 379; 439/113, 114

[56] References Cited

U.S. PATENT DOCUMENTS

| | | | |
|---|---|---|---|
| 1,813,200 | 7/1931 | Rogers | 191/30 |
| 1,904,844 | 4/1933 | Wolf | 191/39 |
| 2,106,565 | 1/1938 | Frank | 191/30 |
| 2,151,099 | 3/1939 | Groendyk | 191/31 X |
| 3,312,399 | 4/1967 | Cruikshank | 238/152 |
| 3,439,131 | 4/1969 | Ross, Jr. | 191/25 |
| 3,952,848 | 4/1976 | Walker et al. | 191/39 X |
| 3,957,142 | 5/1976 | Devolle | 191/30 X |
| 4,598,180 | 7/1986 | Seddon et al. | 191/31 X |

FOREIGN PATENT DOCUMENTS

| | | | |
|---|---|---|---|
| 1935365 | 1/1971 | Fed. Rep. of Germany | 191/39 |
| 3437585 | 4/1986 | Fed. Rep. of Germany | 439/113 |

*Primary Examiner*—Frank E. Werner
*Assistant Examiner*—Scott L. Lowe
*Attorney, Agent, or Firm*—Cohen, Pontani & Lieberman

[57] ABSTRACT

A current contact line arrangement includes a plurality of energy and control current contact lines for engagement with current collectors of a movable energy consumer such as a crane, trolley carriage or the like which is not intended to pass beyond a predetermined point and is characterized by the fact that at least one of the energy or control current contact lines (5) is covered by an insulator (9) which is longer than the brake path of the movable energy consumer.

13 Claims, 2 Drawing Sheets

CURRENT CONTACT LINE ARRANGEMENT

FIELD OF THE INVENTION

The present invention relates to a contact-line arrangement for current collectors of a moveable energy consumer such as cranes, trolley carriages or the like which is not to move past predetermined points.

BACKGROUND AND SUMMARY OF THE INVENTION

Heretofore, limit switches are provided which are not to be passed by movable energy consumers or electric vehicles such as cranes, trolley carriages or the like, so that upon approach a predetermined distance relative to a given point is maintained by the crane. Such limit switches cost about 50 dollars and must be connected by additional lines to the electronic control system thus constituting an unnecessarily high expense for preventing movement of the crane past a given point.

It is therefore an object of the present invention to provide a more economical device for preventing overrunning of a predetermined point. This object is achieved in the manner that at least one of the energy or control contact lines is covered by an insulator which has a length that exceeds the braking path distance of the moveable energy consumer or electric vehicle. Such an insulator is generally about 0.2 to about 0.4 m long, depending on the stop or brake path of the crane, carriage trolley or the like, and costs about 25 to 50 cents, and therefore, only 1% or less of the price of a known limit switch.

The insulator is preferably arranged only on the face of the signal contact line and effectively causes the collector to disconnect from the contact line so that the moveable energy consumer will come to a stop.

In a further embodiment of the present invention, the insulator is made of a plastic having an electric surface resistance of at least about $10^{10}$ ohm and a shape of a U or T section which is undulated or ribbed in to increase the protection against leakage current.

The material of the insulator is selected preferably in accordance with the properties of the current collecting carbon so that suitable gliding properties are obtained and that wear of the insulator is rendered negligible. The insulator can be provided with resilient projections which snap into cuts or tapers provided in the grooves of a contact-line support or, if the contact line has a U-shaped or C-shaped cross-section along the outside of which the current collectors slide, the insulator can have a C-shaped cross-section which surrounds and is clamped to the contact line. To ensure the proper lifting or disconnection of the current collector from the contact lines, the insulator is preferably provided with beveled ends. Suitably the bevel is about 30°.

If there is the danger of the insulator being displaced on or from the contact line, it can be secured in position by gluing, for example, by the application of an adhesive tape which is first attached with the side having the greater adhesive force to the insulator and then secured on the contact line. If the insulator is removed or moved to a different location, the removal of the insulator will simultaneously result in the removal of the adhesive from the contact line.

BRIEF DESCRIPTION OF THE DRAWINGS

Three embodiments of the present invention are shown in the accompanying drawings in which.

DETAILED DESCRIPTION OF THE PRESENTLY PREFERRED EMBODIMENT

Figure 1:
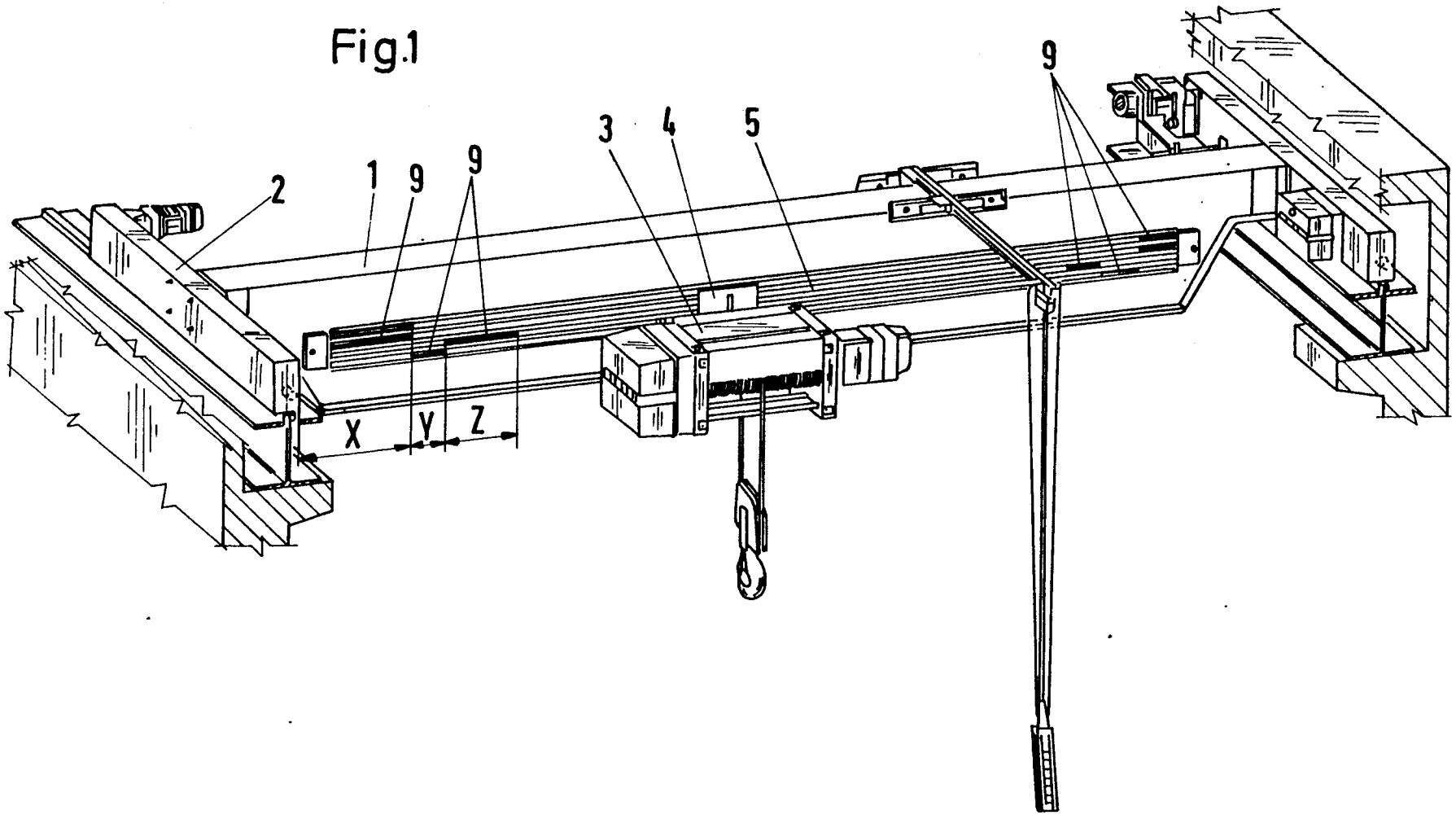
FIG. 1 is a perspective view of a crane with trolley.
Figure 3:
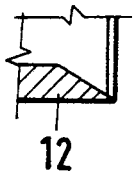
FIG. 3 is a cross-sectional view of the line III—III in FIG. 2.
Figure 5:
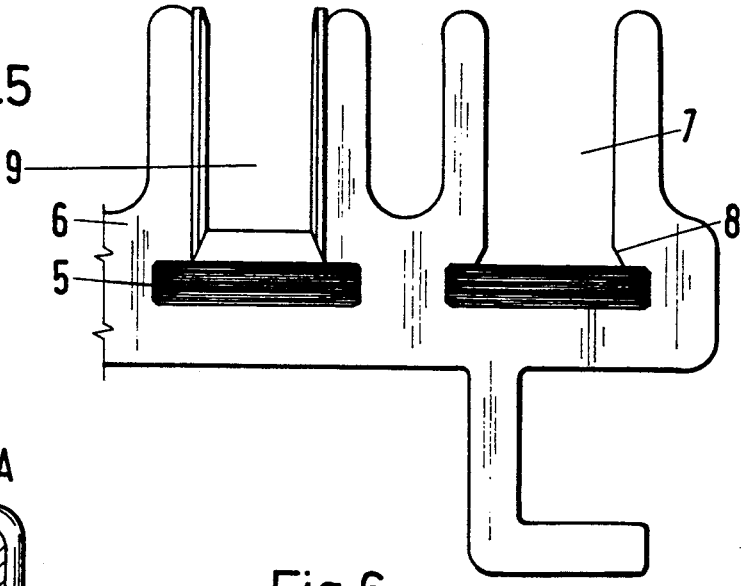
FIG. 5 is an end view of a contact-line holder with contact line and insulator.
Figure 6:
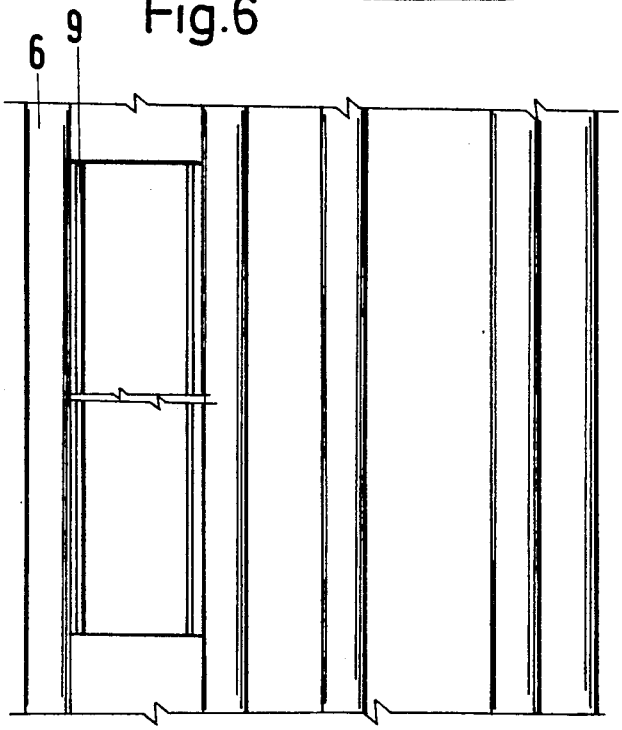
FIG. 6 is a top view of FIG. 5.

In FIG. 1, a trolley 3 is moveable on a crane girder 1, with the current collector 4 of the trolley sliding along one or more contact lines 5 to provide the hoisting-gear motor and traveling-gear motor with current and control signals. To maintain the approach or safety distance X of the trolley 3 on the head girder 2, an insulator 9 is arranged as is, for example, shown in FIGS. 5 and 6, as well as FIGS. 7 and 8 over contact line 5 on that part of the contact line 5 which carries the signal for the traveling motor for the "left" direction of travel which leads to an interruption of travel of the trolley in this direction. The length Y of the insulator 9 is greater than the stop or break path of the trolley 3. Since only the signal for the left direction of travel is interrupted, it is still possible to move the trolley again out of the end region by the "right" direction of travel signal. In the case of trolleys having an additional fast travel speed, insulators of the length Z which interrupt the signal for rapid travel are placed in front of the region Y. In this way, the trolley can still travel with slow speed within the region Z and the region Y can be selected as short as is necessary for stopping from slow speed. Preferably, the insulator (9) has a shape which corresponds essentially to the shape of the contact-line support (6). For example, if the contact-line support (6) is U-shaped with protruding side walls, insulator 9 is preferably also U-shaped with the bottom or bight section (9*a*) resting on the contact line (5) and with the sides or flanges resting against the side walls of the U-shaped contact line support (6). Preferably, the bight section has a thickness of about 1 mm and the flanges have a thickness of about 0.5 mm, respectively. The insulator may also be T-shaped including a horizontal part (9*b*) having a thickness of about 0.5 mm and resting against said contact line (5) and a vertical part (9*c*) of about 3.5 mm.

As an additional safety measure, the travel motor can be interrupted in the region X by insulators on the contact lines for the supply of current if the region Y has been overrun as a result of an error. The measures described herein for the left end of the trolley path can be applied in corresponding manner for the right end of the trolley path.

Figure 2:
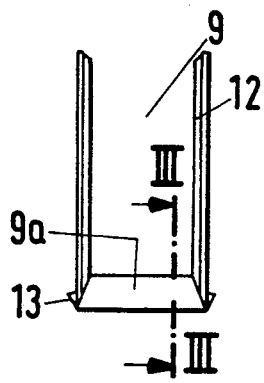
FIG. 2 is an end view of a U-shaped insulator.
Figure 4:
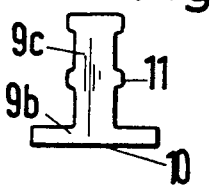
FIG. 4 is an end view of a T-shaped insulator.

In accordance with FIG. 2, the insulator 9 has substantially the shape of a U-section and is provided at its ends with bevels 12 which prevent the striking of the current collector 4 upon travel over the insulator 9. The insulator is inserted by snapping protrusions 13 into tapered section 8 and grooves 7 of a contact-line support 6 and may be secured against displacement by gluing. In accordance with FIG. 4, a T-shaped insulator, the vertical part 9c of which is provided with ribs 11, can also be inserted into the contact-line groove 7. The resting surface 10 of the insulator 9 engages with the sides of the of horizontal part 9b into the tapered section 8 of the contact line support 6.

Figure 7:
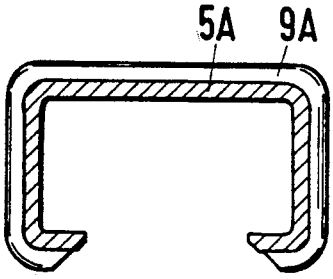
FIG. 7 is a cross-sectional view through a C-shaped contact line with insulator.
Figure 8:
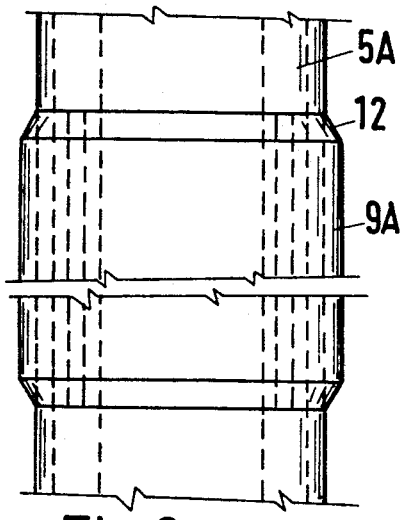
FIG. 8 is a top view of FIG. 7.

The contact line 5a is, in accordance with FIGS. 7 and 8, a C-section onto which the correspondingly shaped insulator 9A is mounted by clamping. Preferably, in all embodiments, the ends of the insulator are provided with bevels 12 at an angle of about 30° to the direction of travel of the current collector.

It should be understood that the preferred embodiments and examples described are for illustrative purposes only and are not to be construed as limiting the scope of the present invention which is properly delineated only in the appended claims.

What is claimed is:

1. In combination a current contact line arrangement for current collectors of a movable electrical vehicle, comprising:

a plurality of contact lines (5) having faces for engagement with a plurality of current collectors of said movable electric vehicle, said electric vehicle having a braking path distance; and an insulator (9) for covering at least one of said faces of at least one of said plurality of contact lines (5), said insulator (9) having a length greater than said braking path distance of said electric vehicle, whereby at least one of said plurality of collectors is removed from electrical contact with said at least one of said plurality of contact lines while said at least one of said plurality of collectors is located at said at least one of said faces of said at least one of said plurality of contact lines.

2. The current contact line arrangement according to claim 1, wherein said at least one of said plurality of contact lines is a control current contact line.

3. The current contact line arrangement according to claim 1, wherein said insulator is made of plastic having an electric surface resistance of at least about $10^{10}$ ohm.

4. The contact line arrangement according to claim 1, additionally comprising a U-shaped contact line support (6) having side walls and carrying said contact lines; said insulator (9) having a U-shaped form including a bight section (9a) having a thickness of about 1 mm and resting on said contact line (5) and flanges having a thickness of about 0.5 mm resting against said side walls of said U-shaped contact line support (6).

5. The contact line arrangement according to claim 1, additionally comprising a U-shaped contact line support (6) having side walls and carrying said contact lines; said insulator (9) having a T-shaped form including a horizontal part (9b) having a thickness of about 0.5 mm and resting on said contact line (5) and against said side walls and a vertical part (9c) of about 3.5 mm.

6. The contact line arrangement according to claim 5, wherein the surface of said vertical part (9c) is provided with ribs (11) as protection against leakage current.

7. The contact line arrangement according to claim 4, wherein said contact line support (6) comprises a U-shaped contact line groove (7) having tapered sections (8), and said insulator (9), additionally comprises protrusions (13) for insertion into said tapered sections (8) of said U-shaped contact line groove (7) of said contact line support (6).

8. The contact line arrangement accordance to claim 1, wherein said contact line is C-shaped and said insulator (9A) is correspondingly C-shaped for surrounding, in clamping fashion, said C-shaped contact line (5A).

9. The contact line arrangement according to claim 1, wherein said insulator (9) has bevel (12) shaped ends.

10. The contact line arrangement according to claim 9, wherein said bevel (12) has a taper of about 30°.

11. The contact line arrangement according to claim 1, wherein said insulator (9) is glued onto said contact line (5).

12. The contact line arrangement according to claim 11, wherein said insulator (9) is attached to said contact line (5) by a double-sided adhesive tape.

13. The contact line arrangement according to claim 12, wherein the adhesive tape has a first and a second side, said first side having a greater adhesive force than said second side, said first side being attached to said insulator (9).

* * * * *